United States Patent [19]

Nitta

[11] Patent Number: 4,466,788

[45] Date of Patent: Aug. 21, 1984

[54] ELECTRONIC GAS LIGHTER

[75] Inventor: Tomio Nitta, Yokohama, Japan

[73] Assignee: Tokai Seiki Co., Ltd., Kanagawa, Japan

[21] Appl. No.: 524,363

[22] Filed: Aug. 18, 1983

[30] Foreign Application Priority Data

Mar. 19, 1982 [JP] Japan ..... 57-39132

[51] Int. Cl.[3] ..... F23Q 7/12

[52] U.S. Cl. ..... 431/255; 431/344

[58] Field of Search ..... 431/130–132, 431/144, 255, 344

[56] References Cited

U.S. PATENT DOCUMENTS

| | | | |
|---|---|---|---|
| 3,425,783 | 2/1969 | Goto | 431/255 |
| 3,494,710 | 2/1970 | Inagaki | 431/255 |
| 3,764,256 | 10/1973 | Moriya | 431/255 |

*Primary Examiner*—Carroll B. Dority, Jr.

*Attorney, Agent, or Firm*—Pasquale A. Razzano

[57] ABSTRACT

In an electronic gas lighter comprising a plastic body, a flame orifice cap having a flame orifice aligned with a fuel outlet nozzle, and an electronic ignition means, the flame orifice cap is provided with a vent opening and a heat dissipating plate. The heat dissipating plate integrally extends from the flame orifice cap along the flow of fuel gas discharged from the nozzle.

7 Claims, 8 Drawing Figures

ELECTRONIC GAS LIGHTER

BACKGROUND OF THE INVENTION

1. Field of the Invention

This invention relates to an electronic gas lighter which utilizes a cell or a piezoelectric element for ignition, and more particularly to an electronic gas lighter having a fuel tank made of plastics and an ignition device mounted on the fuel tank.

2. Description of the Prior Art

There has been in wide use a disposable gas lighter having a plastic fuel tank on which an ignition device is mounted. However, most of the currently available disposable gas lighters having a plastic fuel tank utilize a file wheel and a flint as the ignition device, and disposable electronic gas lighters in which electric discharge spark is used for ignition are not in wide use at present. In this specification, the term "disposable gas lighter" generally refers to an inexpensive gas lighter having a plastic fuel tank irrespective of whether or not it is rechargeable.

One significant difficulty encountered in realizing a disposable electronic gas lighter is providing reliable ignition. That is, the duration of spark discharge used in the electronic gas lighter is very short (15 to 30$\mu$), and therefore fuel cannot be surely ignited unless it is mixed with a sufficient amount of air. Accordingly, the windshield must be provided with a vent opening to feed a sufficient amount of fresh air to the region near the fuel outlet nozzle in which spark discharge is generated.

However, when a sufficient amount of air is fed to the region, fuel burns in the space within the windshield to heat the windshield and the overheated windshield softens and deforms the plastic body or the plastic fuel tank supporting the windshield.

There has been proposed a disposable gas lighter having a plastic body in which a flame orifice cap having a flame orifice is provided above the fuel outlet nozzle so that fuel burns above the flame orifice. However, this solution cannot be directly applied to the electronic gas lighter due to the need to provide reliable ignition as described above.

Thus, in order to realize a practical disposable electronic gas lighter, both of two conflicting demands must be met at least sufficiently for practical use.

SUMMARY OF THE INVENTION

In view of the foregoing observations and description, the primary object of the present invention is to provide a disposable electronic gas lighter in which both said two conflicting demands are well met and accordingly highly reliable ignition is ensured without overheating the windshield.

The disposable electronic gas lighter in accordance with the present invention is provided with a flame orifice cap having a flame orifice on the top and a vent opening on the side wall. The vent opening provides a sufficient amount of fresh air for fuel discharged from the fuel outlet nozzle to obtain an optimal air/fuel ratio required to ignite the fuel. The flame orifice cap is further provided with a heat dissipating plate extending along the flow of the fuel gas discharged from the fuel outlet nozzle. The heat dissipating plate serves to make the fuel gas burn above the flame orifice. That is, the flame forming position of the fuel gas discharged from the nozzle depends upon the temperature and the flow velocity of the fuel gas, and the flame is formed in a position remote from the outlet of the nozzle by a distance which is increased with increase of the flow velocity and with reduction of the temperature of the fuel gas. The heat dissipating plate limits increase in the temperature around the nozzle, partly limits ventilation and prevents reduction of the flow velocity of the fuel gas discharged from the nozzle.

In the disposable electronic gas lighter of the present invention, the flame orifice cap cannot be overheated to deform the plastic body or to change the properties of the same even if the fuel burns for a long time since the flame is formed above the flame orifice, and at the same time, the fuel is surely ignited even if the lighter is repeatedly operated within a short time since a sufficient amount of fresh air is always fed around the nozzle through the vent opening in the flame orifice cap.

The heat dissipating plate may be formed integrally with the flame orifice cap by stamping and forming from a metal sheet. For example, when the flame orifice cap is formed, a part of the metal sheet corresponding to the vent opening is stamped out with a part along one edge of the vent opening remaining uncut, and then the material stamped out from the metal sheet is bent inwardly along the edge and is further bent at an intermediate portion thereof to extend in the direction parallel to the flow of the fuel gas discharged from the nozzle. Accordingly, the flame orifice cap can be produced at a cost equivalent to that of the conventional flame orifice cap without a vent opening and a heat dissipating plate.

DESCRIPTION OF THE PREFERRED EMBODIMENT

Figure 1A:
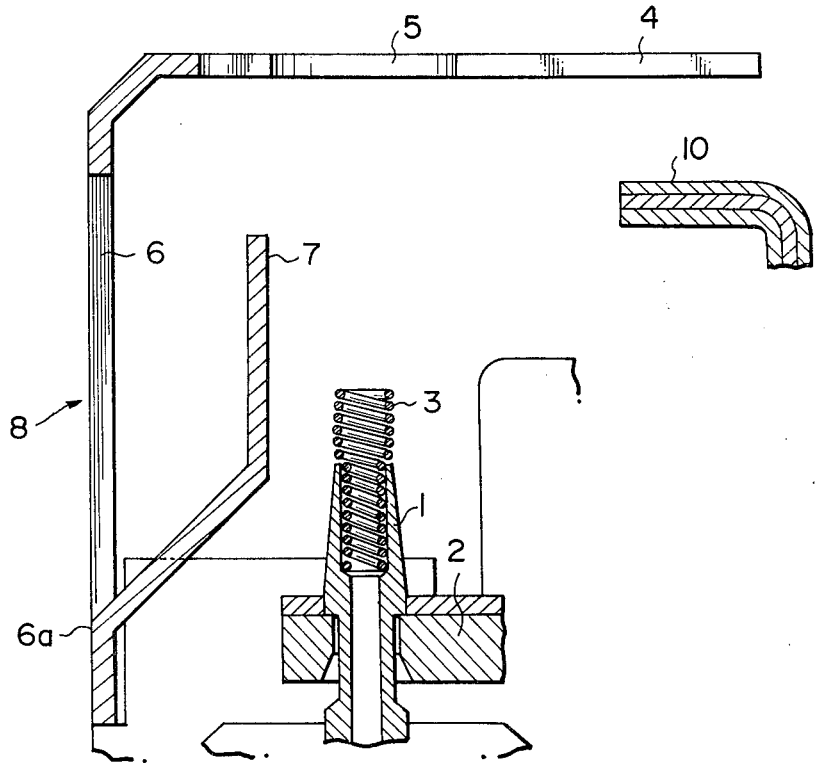
FIG. 1A is a fragmentary cross sectional view of a disposable electronic gas lighter in accordance with an embodiment of the present invention.
Figure 1B:
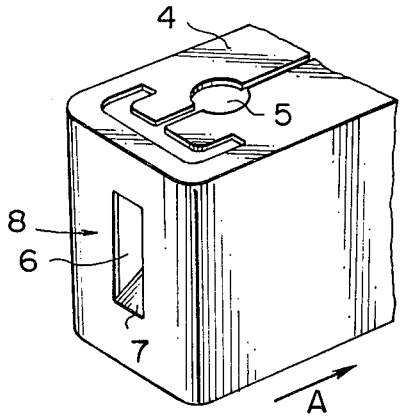
FIG. 1B is a fragmentary perspective view of the disposable electronic gas lighter of FIG. 1A.
Figure 1C:
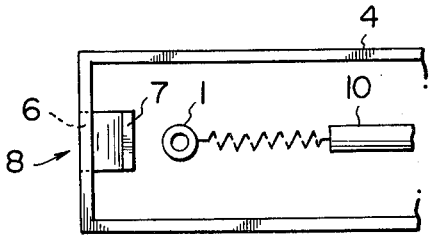
FIG. 1C is a schematic plan view of FIG. 1B.

Referring to FIGS. 1A to 1C, a fuel outlet nozzle 1 is engaged with a nozzle opening lever 2 to discharge fuel gas when the nozzle opening lever 2 is actuated to lift the nozzle 1. On the upper end portion of the nozzle 1 is mounted a coil spring 3 which serves to mix fuel gas discharged from the nozzle 1 with air in a ratio optimal for ignition. A discharge electrode 10 is disposed on the upper right side of the nozzle 1. A flame orifice cap 4, made of metal, is mounted on a plastic body (not shown) to cover the nozzle 1. The flame orifice cap 4 has a flame orifice 5 which is disposed above the nozzle 1. The diameter of the flame orifice 5 is made as small as possible within a range in which a fine spindle-shaped flame is formed above the flame orifice 5 and the fuel gas does not burn in the space within the flame orifice cap 4. A vent opening 6 for feeding air toward the nozzle 1 is formed in the shorter side wall 8 remote from the discharge electrode 10. Though the shape of the vent opening 6 is substantially rectangular as clearly shown in FIG. 2B in this embodiment, the vent opening 6 may of any shape, e.g., square or triangle, insofar as a sufficient amount of air can be fed therethrough. A rectangular portion is stamped out from the metal sheet forming the flame orifice cap 4 with its lower edge 6*a* remaining uncut and the rectangular portion is bent inwardly along the lower edge 6*a* to form the vent opening 6. The rectangular portion is further bent upwardly at about the middle between the upper edge and the lower edge 6*a* so that the upper half extends along the flow of fuel gas discharged from the nozzle 1. The rectangular portion thus formed constitutes a heat dissipating plate 7. An inverted U-shaped portion may be stamped out instead of the rectangular portion to form a U-shaped vent opening.

When an actuator (not shown) is depressed and the nozzle opening lever 2 is actuated to lift the nozzle 1, fuel gas is discharged through the nozzle 1 upwardly. The fuel gas is mixed with air in a ratio optimal for ignition by virtue of the coil spring 3. The vent opening 6 feeds a sufficient amount of fresh air around the nozzle 1 and at the same time repels gaseous residue around the nozzle 1 such as gases formed by combustion of the fuel gas or the fuel gas which remains around the nozzle 1 when it fails to ignite, whereby a constant air/fuel ratio is always obtained for each igniting operation. When spark discharge is subsequently generated, the fuel gas discharged from the nozzle 1 is ignited and momentarily burns in the flame orifice cap 4. However, since the heat dissipating plate 7 extends along the flow of the fuel gas near the nozzle 1, diffusion of the fuel gas discharged from the nozzle 1 is prevented and the fuel gas reaches the flame orifice 5 maintaining the flow velocity immediately after discharge from the nozzle 1. Further, since heat produced around the nozzle 1 is dissipated by way of the heat dissipating plate 7 and the flame orifice cap 4 made of metal, increase in temperature around the nozzle 1 is limited and the flow velocity of air fed to the fuel gas burning in the flame orifice cap 4 is limited by the heat dissipating plate 7. Accordingly, the flame momentarily formed in the flame orifice cap 4 cannot dwell therein and moves to above the flame orifice 5. Further, since a sufficient amount of fresh air is always fed around the nozzle 1 through the vent opening 6, fuel gas is surely ignited even if the lighter is repeatedly operated within a short time.

Figure 2A:
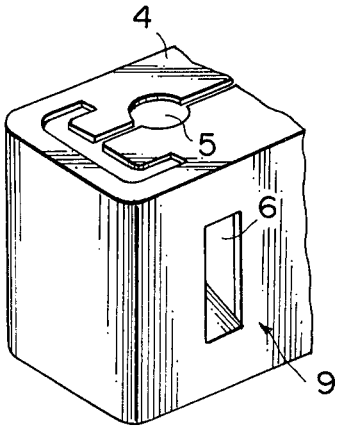
FIG. 2A is a fragmentary perspective view of a disposable electronic gas lighter in accordance with another embodiment of the present invention.
Figure 2B:
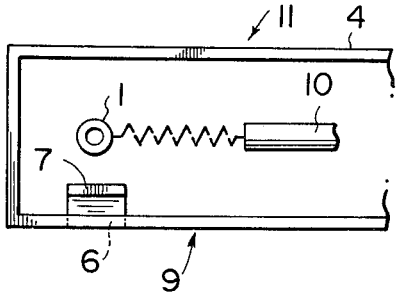
FIG. 2B is a schematic plan view of FIG. 2A, FIGS. 3 and 4 are views similar to FIG. 2B but illustrating third and fourth embodiments of the present invention.

Though in the embodiment shown in FIGS. 1A and 1C, the vent opening 6 and the heat dissipating plate 7 are disposed in the shorter side wall 8 remote from the spark discharge electrode 10, the vent opening 6 and the heat dissipating plate 7 may be formed in one longer side wall 9 as shown in FIGS. 2A and 2B.

Figure 3:
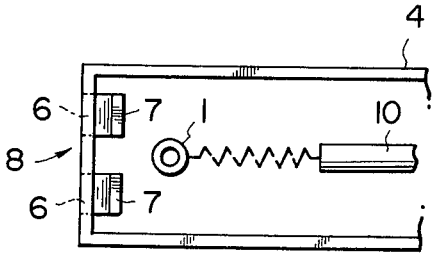

Further, a plurality of vent openings 6 and a plurality of heat dissipating plates 7 may be provided in the shorter side wall 8 as shown in FIG. 3.

Figure 4:
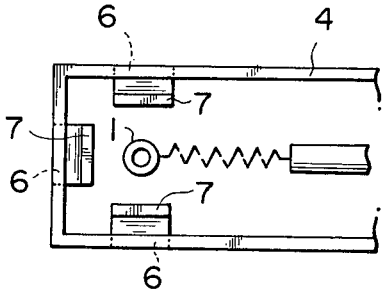

In still another embodiment of the present invention shown in FIG. 4, a single vent opening 6 and a single heat dissipating plate 7 is provided in each of the shorter side wall remote from the spark discharge electrode and the longer side walls.

Figure 5:
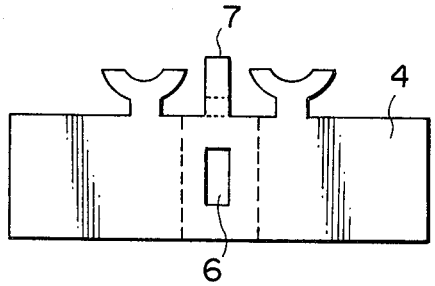
FIG. 5 is a development of the flame orifice cap used in a fifth embodiment of the present invention.

In the embodiments described above, the heat dissipating plate 7 is formed by bending the material stamped out from the metal sheet when forming the vent opening 6, the heat dissipating plate 7 may be formed independently from the vent opening 6 as shown in FIG. 5 which is a development of a flame orifice cap employed in still another embodiment of the present invention.

I claim:

1. An electronic gas lighter comprising a plastic body, a flame orifice cap having long side walls and short side walls and which is mounted on the body over a fuel outlet nozzle and has a flame orifice aligned with the nozzle and an electronic ignition means which generates spark discharge near the nozzle characterized in that at least one vent opening is provided in the side wall of the flame orifice cap and at least one heat dissipating plate is provided integrally with the flame orifice cap and spaced between the vent opening and nozzle and extending along the flow of fuel discharged from the fuel outlet nozzle.

2. An electronic gas lighter as defined in claim 1 in which a single vent opening and a single heat dissipating plate are formed in the shorter side wall of the flame orifice cap remote from the electronic ignition means.

3. An electronic gas lighter as defined in claim 1 in which a single vent opening and a single heat dissipating plate are provided in one longer side wall of the flame orifice cap.

4. An electronic gas lighter as defined in claim 1 in which each of the longer side walls and the shorter side walls remote from the ignition means of the flame orifice cap is provided with a single vent opening and a single heat dissipating plate.

5. An electronic gas lighter as defined in claim 1 in which a pair of vent openings and a pair of heat dissipating plates are provided in the shorter side wall of the flame orifice cap remote from the electronic ignition means.

6. An electronic gas lighter as defined in claim 1, 2, 3, 4 or 5 in which said flame orifice cap is formed from a metal sheet by stamping and forming.

7. An electronic gas lighter as defined in claim 6 in which said heat dissipating plate is formed by bending material stamped out from the metal sheet when forming said vent opening with the part corresponding to one edge of the vent opening remaining uncut.

* * * * *